US007498502B2

(12) United States Patent
Saito et al.

(10) Patent No.: US 7,498,502 B2
(45) Date of Patent: Mar. 3, 2009

(54) KEYBOARD MUSICAL INSTRUMENT HAVING ACCOMMODATION SPACE FOR FALLBOARD BETWEEN KEYBOARD AND REAR TOP BOARD

(75) Inventors: Daisuke Saito, Hamamatsu (JP); David Keech, Hertfordshire (GB)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/645,905

(22) Filed: Dec. 26, 2006

(65) Prior Publication Data

US 2007/0221037 A1 Sep. 27, 2007

(30) Foreign Application Priority Data

Dec. 27, 2005 (JP) ..... 2005-374114
Nov. 10, 2006 (JP) ..... 2006-304761

(51) Int. Cl.
*G10C 3/02* (2006.01)
*G10F 1/02* (2006.01)

(52) U.S. Cl. ..... 84/423 R; 84/30; 84/80; 84/179

(58) Field of Classification Search ..... 84/13, 84/30–32, 34–38, 47, 80–82, 170–172, 174–184, 84/192–196, 329, 423 R, 424, 425, 429
See application file for complete search history.

(56) References Cited

U.S. PATENT DOCUMENTS

| | | | | |
|---|---|---|---|---|
| 4,593,593 | A * | 6/1986 | Bellini | 84/177 |
| 5,056,396 | A * | 10/1991 | Furukawa | 84/179 |
| 5,175,386 | A * | 12/1992 | Kuwahara | 84/179 |
| 5,837,911 | A * | 11/1998 | Inoue | 84/179 |
| 2001/0037717 | A1 * | 11/2001 | Suzuki | 84/179 |
| 2002/0139236 | A1 * | 10/2002 | Sandifer | 84/179 |
| 2004/0182223 | A1 * | 9/2004 | Kuwahara et al. | 84/423 R |
| 2004/0250671 | A1 * | 12/2004 | Ohno et al. | 84/177 |

FOREIGN PATENT DOCUMENTS

JP 2571343 2/1998

* cited by examiner

*Primary Examiner*—Jeffrey Donels
*Assistant Examiner*—Christopher Uhlir
(74) *Attorney, Agent, or Firm*—Morrison & Foerster LLP

(57) ABSTRACT

A keyboard musical instrument comprises a keyboard having a plurality of playing keys, a fallboard pivotably supported at its rear end for covering the keyboard when the instrument is not in use and exposing the keyboard when the instrument is in use, and a rear top board. An accommodation space is provided between the keyboard and the rear top board and is adapted for receiving the fallboard which turns through 180 degrees to wide open the space from above the keyboard through above the rear top board. Thus, while the instrument is in use, the fallboard will obstruct neither the player's view nor the sound propagation from the loudspeakers, and further the fallboard will help in supporting the music sheets.

7 Claims, 7 Drawing Sheets

General View of Electronic Piano with Fallboard Closed

General View of Electronic Piano with Fallboard Opened

General View of Electronic Piano with Fallboard Opened

KEYBOARD MUSICAL INSTRUMENT HAVING ACCOMMODATION SPACE FOR FALLBOARD BETWEEN KEYBOARD AND REAR TOP BOARD

TECHNICAL FIELD

The present invention relates to a keyboard musical instrument such as an electronic piano, and more particularly to a keyboard musical instrument having an accommodation space between the keyboard and the rear top board for the reception of the fallboard which is pivotable about a horizontal axis near its rear end to cover the keyboard when the instrument is not in use and uncover the keyboard when the instrument is in use, the accommodation space substantially receiving the fallboard to allow for an unobstructed space between the rear top board and the user.

BACKGROUND INFORMATION

A keyboard musical instrument such as an electronic piano is provided with a keyboard lid such as a fallboard to cover and protect the keyboard. The keyboard lid is generally of a type which just open and close the keyboard part of the instrument by turning the pivoted lid through a limited angle of about 100 or 120 degrees to expose or hide the keyboard. This type of keyboard lid is really useful for protecting the keyboard when it is closed, where the instrument is not in use, but is useless or rather obstructive where the instrument is being played by the performer. To mitigate the obstructiveness, a keyboard lid of a sliding shutter type was devised as shown in registered Japanese utility model publication No. 2,571,343 in which the shutter plate is slid into the instrument housing to hide the shutter plate while exposing the keyboard.

Such an instrument having a fallboard of a pivoted lid type turning through a limited angle may cause some inconveniences including the following. The fallboard will stand aslant upward at the rear end of the keyboard and obstruct the player's view ahead, so that communications between the keyboard instrument player and other instrument players may be spoiled especially in the case of an ensemble. Where speakers are provided on the rear top board of the keyboard musical instrument, as is often the case with electronic pianos, the obliquely standing fallboard to open the keyboard part will hinder the emitted sounds of the loudspeakers from reaching the player's ears, which may ruin the tone quality of the sounds perceived by the player. On the other hand, in the case of an instrument having a sliding keyboard lid such as shown in the above-referenced Japanese utility model publication, the mechanism of hiding the keyboard lid will be complicated and the instrument housing will be bulky accordingly. In either case, the keyboard lid will not play a useful role while the keyboard instrument is being played.

SUMMARY OF THE INVENTION

In view of the foregoing background, therefore, it is a primary object of the present invention to provide a keyboard musical instrument having a fallboard which is unobstructive as well as useful while the instrument is in use. More particularly, while the instrument is in use, the fallboard will obstruct neither the player's view nor the sound propagation from the loudspeakers, and further the fallboard will help in supporting the music sheets.

According to the present invention, the object is accomplished by providing a keyboard musical instrument comprising: two side boards provided apart from each other, each having front part with a top edge and rear part with an upper region; a keyboard including a plurality of playing keys, provided between the two side boards at the front parts thereof; a rear top board provided bridging the upper regions of the rear parts of the two side boards; a fallboard having an outer surface, an inner surface, a front edge region and a rear edge region, pivotably supported to turn about a pivot axis at the rear edge region between the two side boards, and covering the keyboard when the fallboard is closed by turning frontward with the outer surface facing upward, while exposing the keyboard when the fallboard is opened by turning rearward with the inner surface facing upward; and an accommodation space provided between the keyboard and the rear top board between the two side boards, and adapted for receiving the fallboard when the fallboard is turned rearward with the inner surface facing upward. The fallboard, when opened, lies within the accommodation space with its inner surface facing upward, the user can put on music sheets or else there, which will be convenient for the user. Further, there will be no substantial obstacles for the user's view and the emitted sounds during the use.

In an aspect of the present invention, the accommodation space may be a recess formed between the two side boards, the fallboard may have a substantial part formed as a substantially flat plate carrying the outer surface and the inner surface, the front edge region may be formed with a front skirt for covering front side of the keyboard when the fallboard is closed, and the recess may be formed with substantially flat bed part at a height which will keep the inner surface of the fallboard not higher than the top edges of the front parts of the two side boards when the fallboard is received in the accommodation space, and the front skirt may be formed to have a height which is less than the difference between the height of the rear top board and the height of the bed part but is greater than the height of the playing keys to be covered. The fallboard will be fully accommodated in the recess, while the instrument is in use.

In another aspect of the present invention, the front edge region of the fallboard may be integrally formed with and gradually curving downward from the flat plate part of the fallboard. The gradually curved surface, when directed upward as the fallboard is turned open, will help in reading the music sheets, the upper portion curving toward the user.

In a further aspect of the present invention, the recess may be formed with a rear end wall connected with the bed part and rising toward the rear top board, the rising wall having a shape which matches the shape of the front skirt in the front edge region of the fallboard, when the fallboard is received in the accommodation space, and the top edges of the side boards may be shaped along the shape of the flat plate part and the rising wall adjacent to the side boards. The music sheets can be placed on the turned (i.e. opened) fallboard beyond the rightmost and leftmost ends over the top edges of the side boards.

In a still further aspect of the present invention, the accommodation space may be a recess formed between the two side boards and have a substantially flat bed part and a rear end wall having a wall height and connected with the flat bed part, and the top edges of the front parts of the side boards may extend from its front to the rear end of the bed part at a height lower than the rear top board by a height difference which is less than the wall height. As the upper ends of the front part and of the rear part of the side board are stepped with a small height difference, the appearance of the instrument becomes soft and friendly to the audience.

In a still further aspect of the present invention, the fallboard may have a ridge formed around the pivot axis at the rear end region so that the ridge protrudes upward from the flat plate part of the fallboard when the fallboard is turned open and lies on the accommodation space. While the fallboard is turned open with its inner surface facing upward, the ridge will serve to prevent the music sheets or pencils or else which are placed on the fallboard from inadvertently falling down from the rear edge of the fallboard on to the keyboard.

In a still further aspect of the present invention, the keyboard musical instrument may further comprise a plurality of loudspeakers arrayed on the rear top board in a direction parallel to the direction in which the plurality of playing keys are arrayed in the keyboard. The sounds emitted from the loudspeakers will not be obstructed by the fallboard, as the fallboard is received or hidden in the accommodation space.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described bellow.

BRIEF DESCRIPTION OF THE DRAWINGS

For a better understanding of the present invention, and to show how the same may be practiced and will work, reference will now be made, by way of example, to the accompanying drawings, in which.

DETAILED DESCRIPTION OF EMBODIMENTS OF THE INVENTION

The present invention will now be described in detail with reference to the drawings showing preferred embodiments thereof. It should, however, be understood that the illustrated embodiments are merely examples for the purpose of understanding the invention, and should not be taken as limiting the scope of the invention.

General Structure of Embodiment

Figure 1:
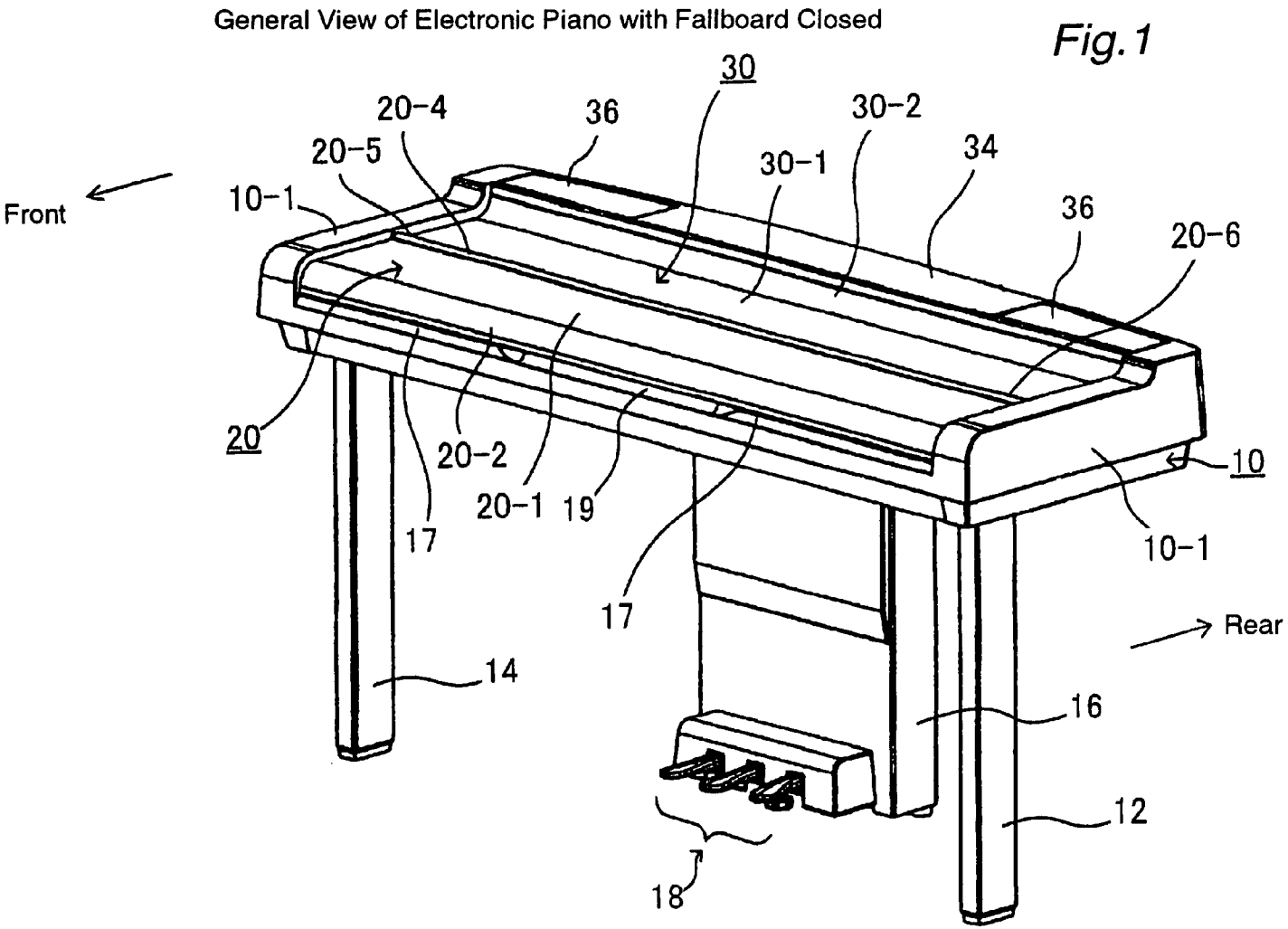
FIG. 1 is a general perspective view of an electronic piano having a fallboard according to an embodiment of the present invention, with the fallboard being closed.

FIG. 1 shows an overall view of an electronic piano to illustrate a general structure of an embodiment of the present invention. The numeral 10 generally denotes a main body (or housing) of an electronic piano shaped generally in a horizontally elongated rectangular box (or cuboid) including a right and left side boards 10-1. Beneath the main body 10, near the right and left ends in the front part, are provided columnar supporting legs (or pillars) 12 and 14 extending downward. There is also provided a central supporting leg 16 of a horizontally wide flat box shape extending downward beneath the main body 10 in its central area in the rear part. The main body 10 is supported by these legs 12, 14 and 16. Pedals 18 are provided at the bottom of the central supporting leg 16 extending frontward therefrom.

The numeral 20 denotes a fallboard or keyboard lid, in its closed position, having a major part 20-1 of a flat plate shape, a front edge region 20-2 extending frontward from the flat plate part 20-1 and arcuately curving downward to form a front skirt, and a rear edge region 20-4 of a horizontally extending ridge shape. At the both (left and right) ends 20-5 and 20-6 of the ridged rear edge region 20-4, the fallboard 20 is pivotably supported on the side boards 10-1 of the main body 10. The pivot axis lies substantially on the plane defined by the extension of the flat plate part 20-1. The main body 10 has, at its front end and separated apart by a cutout 19, keyslips 17, 17 to which the front bottom edge of the front skirt 20-2 abuts. Each of the keyslips 17, 17 is a member of a rectangular bar having a thickness of about several centimeters and a length of about one third of the horizontal length (i.e. width) of the main body 10 or of the keyboard and projecting upward, leaving the cutout 19 which has a length of about one third of the width of the main body 10 so that the user can insert his/her fingers for opening the fallboard.

The numeral 34 denotes a rear top board which constitutes the highest part of the main body 10 and on which are provided loudspeakers 36, 36 near the right and left ends. The numeral 30 denotes an accommodation space for receiving the fallboard 20 when the fallboard 20 is turned open while the keyboard musical instrument is in use. The accommodation space 30 is in the form of a recess formed between the closed fallboard 20 and the rear top board 34 and between the two side boards 10-1, having a bed part 30-1 constituting a major part of the recess 30 and a rear end wall 30-2 connecting to the bed part 30-1. The height of the bed part 30-1 is approximately the same as the outer surface of the flat plate part 20-1 of the closed fallboard 20. The rear end wall 30-2 is curved with a curvature similar to the curvature of the front skirt 20-2 of the fallboard 20 to reach the height of the rear top board 34.

Figure 2:
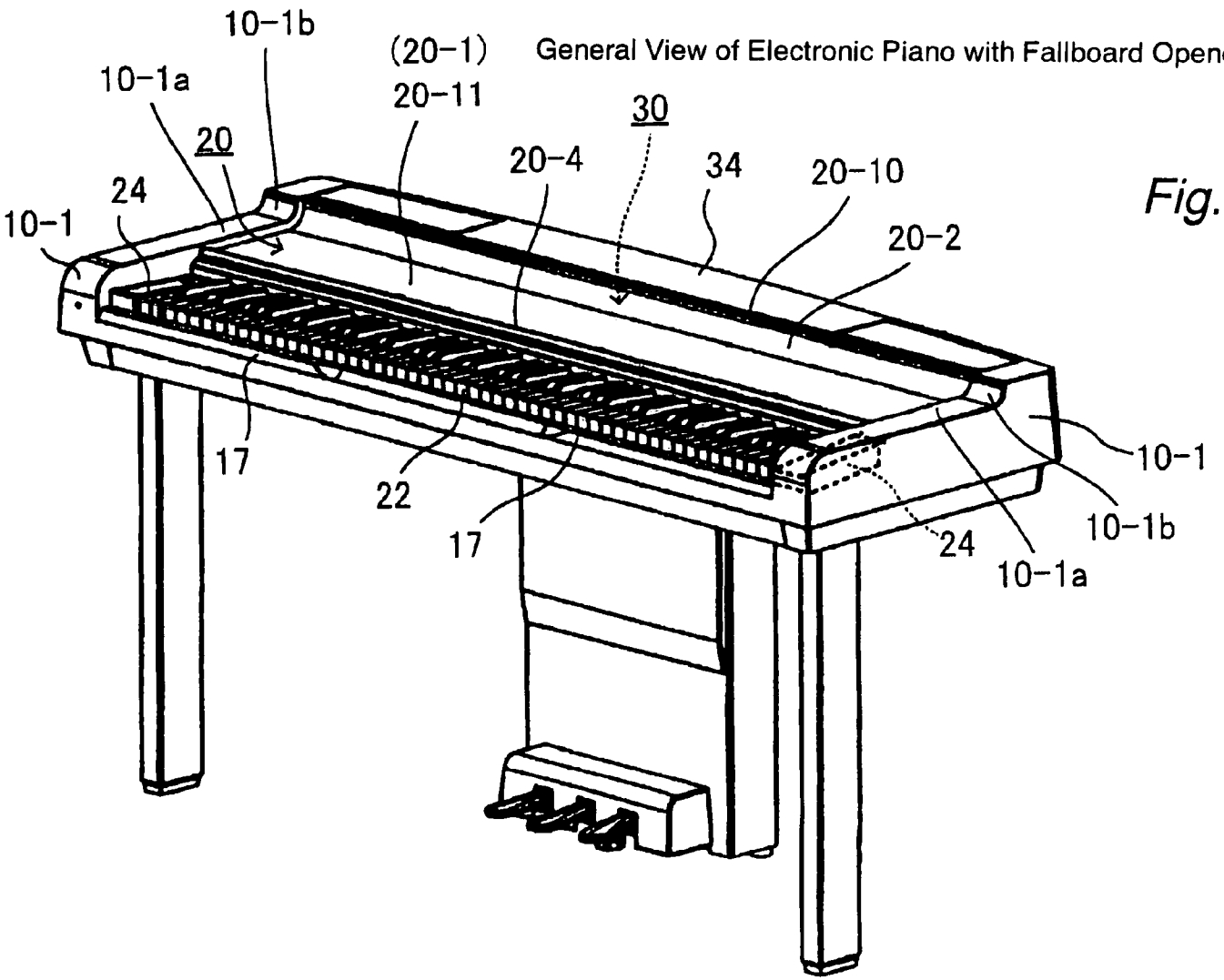
FIG. 2 is a general perspective view of an electronic piano having a fallboard according to an embodiment of the present invention, with the fallboard being opened.

FIG. 2 shows a general perspective view of the electronic piano with the fallboard being opened, while the electronic piano is in use. The fallboard 20 is pivotally turned rearward by an angle of 180 degrees from the closed position as illustrated in FIG. 1, and is received in the accommodation space 30 thereby exposing a keyboard 22 and keyboard end blocks 24, 24. The fallboard 20 lies on the bed part 30-1 of the recess 30 and the inner surface 20-11 of the flat plate part 20-1 becomes level facing upward. The upward directing inner surface 20-11 of the flat plate part 20-1 locates at a height which is lower than the top edges of the side boards 10-1 constituting the right and left end plates of the main body 10 by several millimeters, and will be invisible as viewed in a side elevation. This condition is herein called as "being accommodated" in connection with the embodiment. Further, the dimensions of the various parts of the fallboard 20 and the accommodation space 30 are so determined that the tip edge 20-10 (this is called "front bottom edge" in the above description about the closed position) of the front skirt 20-2 of the fallboard 20 will be at the same height as the upper surface of the rear top board 34 when the fallboard 20 is in the opened position.

More specifically, the top edge 10-1*a* of the side board 10 at the part which is adjacent to the flat plate part 20-1 of the fallboard 20 in its opened position has the same height (or a bit higher height) as the flat plate part 20-1, and the top edge 10-1*b* of the side board 10 at the part which is adjacent to the curved front skirt 20-2 of the fallboard 20 in its opened position is curved in parallel (with the same curvature) to the curved inner surface (now directing upward) of the curved front skirt 20-2.

Detailed Structure of Fallboard and Accommodation Space

Figure 3:
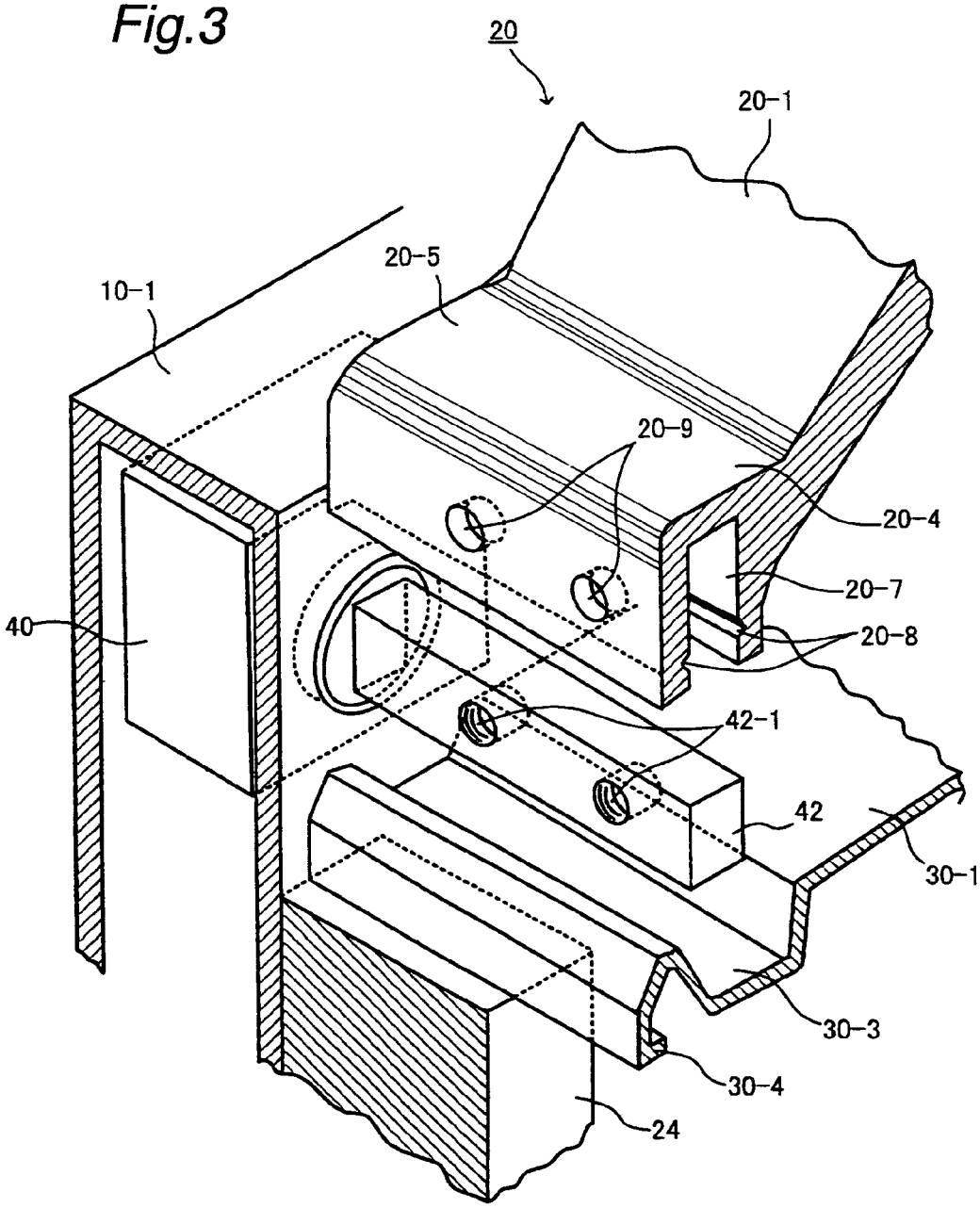
FIG. 3 is a partially-sectioned disassembled fragmentary perspective view near the pivot shaft of the fallboard according to an embodiment of the present invention.

Herein below will be described the detailed structures of the fallboard 20 and the accommodation space 30 with reference to FIG. 3. FIG. 3 illustrates the portion at which the fallboard 20 is pivoted on the left side board 10-1 of the main body 10 in a partially-sectioned disassembled fragmentary perspective view. A pivot shaft 42 in the shape of a rectangular bar is rotatably mounted on the inner vertical face of the left side board 10-1, projecting inward (i.e. rightward). Although not shown in the drawing, another pivot shaft of the same shape is also rotatably mounted on the inner vertical face of the right side board 10-1, projecting inward (i.e. leftward). Each of the pivot shafts 42 has a length of about 10 centimeters. A pivot bearing 40 is embedded in the side board 10-1 to rotatably support the pivot shaft 42. The pivot bearing 40 is equipped with a brake which works to damp the rotation of the pivot shaft 42 in predetermined angle ranges before the complete opening and before the complete closure of the fall board to prevent an accident of shutting the fingers of the user.

A U-shaped channel 20-7 is provided in the ridged rear edge region 20-4 of the fallboard 20 to hold the pivot shaft 42. On the inner surfaces of the channel 20-7 near its open ends are provided shallow notches 20-8 to snap in a rubber cap after the pivot shaft 42 is completely engaged in the channel 20-7. To the rear edge region 20-4 at the closed side of the channel 20-7 is connected the flat plate part 20-1 of the fallboard at an angle of 45 degrees with respect to the slot plane of the U channel 20-7 so that the engaged pivot axis 42 comes substantially on the plane defined by the extension of the flat plate part 20-1. Female screws 42-1 are threaded in the side surface of the pivot shaft 42, and through holes 20-9 are provided in the wall of the U channel 20-7 at the corresponding positions of the left end 20-5 of the ridged rear edge region 20-4. The U channel 20-7 is engaged with the pivot shaft 42, and bolts are screwed into the female screws 42-1 through the through holes 20-9, and thus the fallboard 20 is fixed to the pivot shaft 42 at the left end of the fallboard 20. The like engagement is established at the right end (not shown) of the fallboard 20. The fallboard 20 is now turnable about the pivot shaft 42 to open and close the keyboard of the keyboard musical instrument, the pivot axis (i.e. the axis of turning of the fallboard) lying substantially on the plane defined by the extension of the flat plate part 20-1 of the fallboard 20.

In the case of the conventional keyboard musical instrument, the center of turning of the fallboard is usually positioned below the plane of the plat plate part (which is the part that corresponds to the part 20-1 of the present invention) of the fallboard as viewed while the fallboard is in its closed position. With such a positioning, if the fallboard should be designed to be turnable through 180 degrees, the fallboard would go lower into the instrument body. Then, the instrument body should be designed to have a margin for allowing such lowering, which would inevitably require a bulky body of the keyboard musical instrument. On the contrary in the case of the described embodiment of the present invention, the axis of turning (indicated by P in FIG. 4) is positioned on the plane defined by the extension of the flat plate part 20-1 with the ridged rear end region 20-4 surrounding the axis of turning, and thus the fallboard 20 can be turned through 180 degrees to open the keyboard area with the flat plate part 20-1 coming to the height substantially the same as the height at its closed position. This will advantageously enable the design of a slimmer body of the keyboard musical instrument as compared with the conventional keyboard musical instrument.

Figure 4:
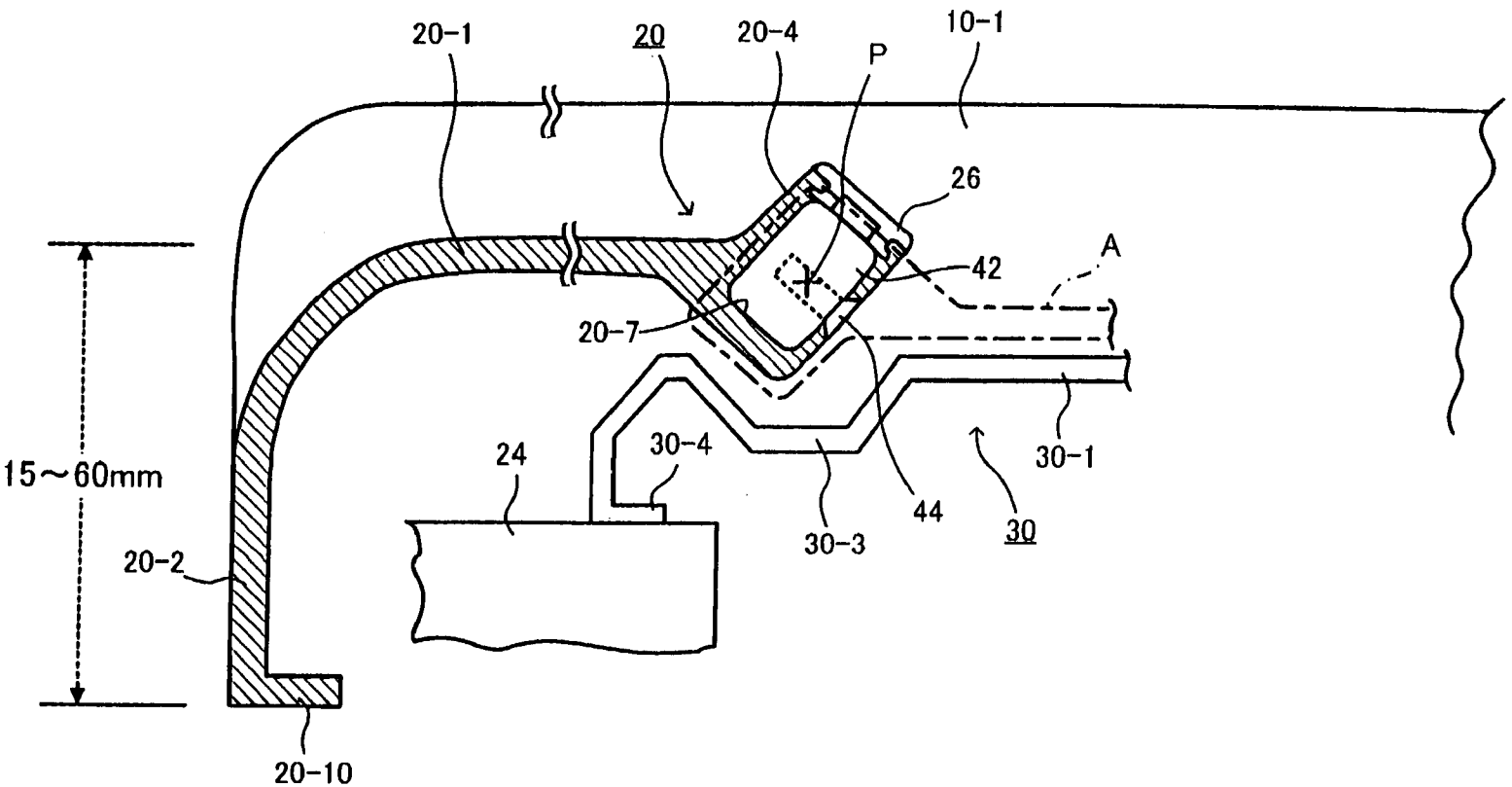
FIG. 4 is a partially-sectioned assembled fragmentary side view near the pivot shaft of the fallboard according to an embodiment of the present invention.

FIG. 4 is a partially-sectioned fragmentary side view near the pivot shaft illustrating the fallboard 20 and the pivot shaft 42 which are assembled with the screws as described above. In FIG. 4, a screw 44 passes through the wall of the channel 20-7 at the ridged rear end region 20-4 into the pivot shaft 42 and the opening of the channel 20-7 is closed by a rubber cap 26, and the fallboard 20 is in its closed position. The lower end of the front skirt 20-2 is further extended inward to form an L-shaped flange 20-10, which will serve as a lug for the user when handling the fallboard. In the front of the accommodation space 30, an inverted trapezoidal channel 30-3 is formed integrally connected to the bed part 30-1 just under the ridged rear edge region 20-4 so as not to obstruct the turning movement of the fallboard 20. The final end edge 30-4 of the accommodation space forming member is fixed on the keyboard end blocks 24.

The height of the front edge region 20-2 of the fallboard 20 should be sufficient for securing a space above the keyboard 22, while a too high region 20-2 would necessitate an accordingly high rear end wall 30-2 of the accommodation space 30, which would in turn deteriorate the user's view. In this connection, the height of the front skirt 20-2 is preferably 15 through 60 millimeters as shown in FIG. 4, although it depends on the configuration of the keyboard in the individual musical instrument.

Figure 5:
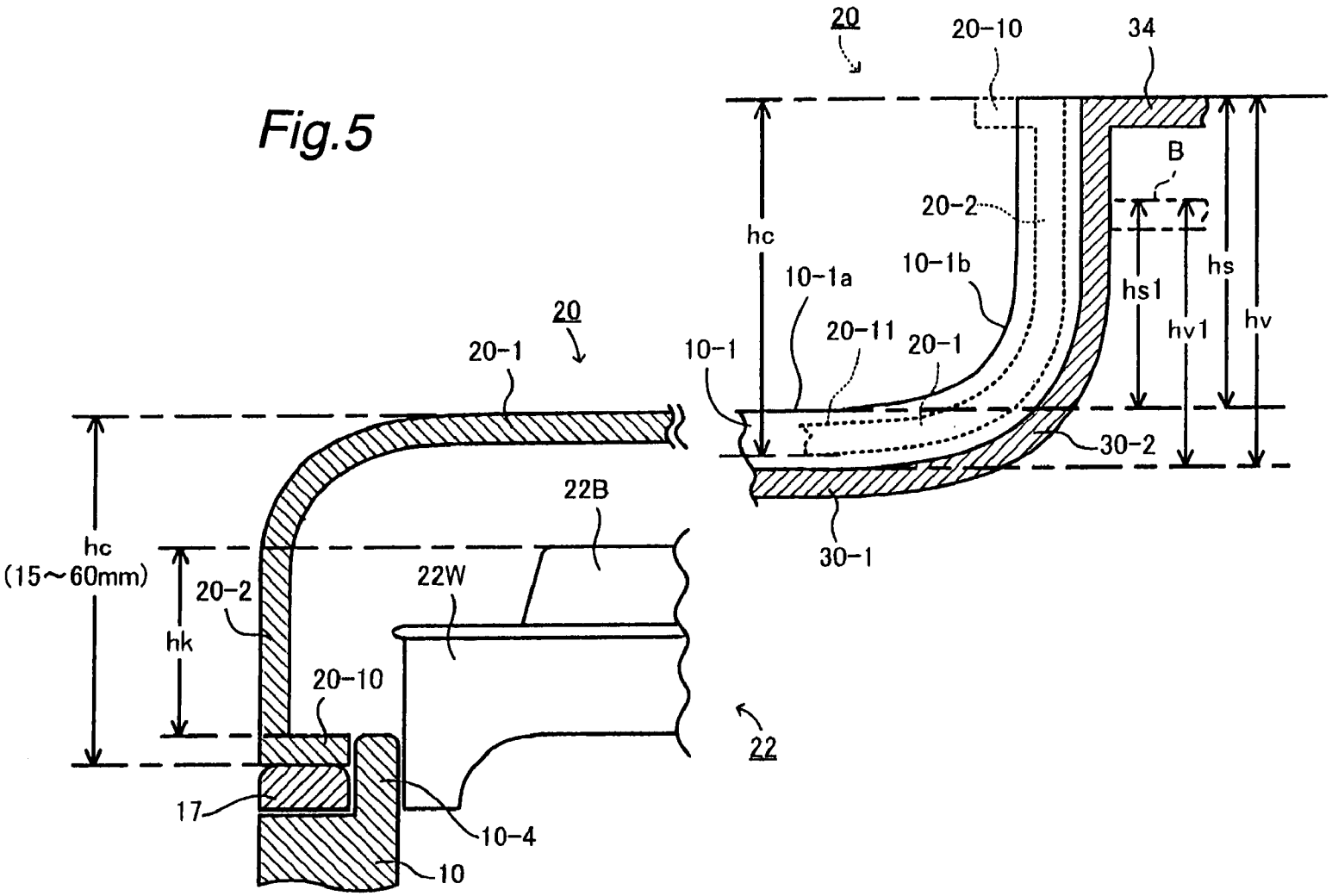
FIG. 5 is a partly omitted fragmentary side view of the fallboard according to an embodiment of the present invention, illustrating the dimensions of the respective portions.

FIG. 5 illustrates, in a partly omitted fragmentary side view, various dimensions of the fallboard of an embodiment. The keyboard 22 comprises white keys 22W and black keys 22B, and the lower part of the front faces of the white keys 22W is hidden by a key front wall 10-4 formed integrally with the main body 10. A key height hk is defined as the height of the visible part of the keyboard measuring from the top end of the key front wall 10-4 to the top end of the black key 22B. The height hc of the front skirt 20-2 of the fallboard 20 is made greater than the key height hk. When the keyboard 20 is in its opened position (shown by the dotted line), the dimensions of the various parts of the accommodation space 30 are so determined that the inner surface 20-11 of the flat plate part 20-1 is level with or lower than the top edge 10-1*a* of the front part of the side board 10-1. An accommodation height hv which is defined as the height difference between the bed part 30-1 and the rear top board 34 is made greater than the height hc of the front skirt 20-2 of the fallboard 20. The side board 10-1 is further extended rearward from the part adjacent to the keyboard 22 toward the rear part having a raised upper region with the top edge curving upward to the rear top board 34. As the top edge 10-1*a* of the front part of the side board 10-1 is made higher than the surface of the bed part 30-1 of the accommodation space 30, the height hs of the top edge 10-1*b* of the raised rear region as measured from the top edge 10-1*a* is less than the accommodation height hv.

Function of Embodiment

With the embodiment of the above structure, as the user pulls up the front skirt 20-2 of the fallboard 20 by inserting his/her fingers into the cutout 19, the fallboard 20 is turned to the position in which the flat plate part 20-1 lies horizontally as shown by a dash-single-dot line A in FIG. 4. In the position A, the flat plate part 20-1 lies on the bed part 30-1 of the accommodation space and the front skirt 20-2 matches the rear end wall 30-2, the fallboard 20 being held in the accommodation space 30 throughout its broad area. Thus, the fallboard 20 formed with a thin member as shown in FIG. 4 will lies stably on the accommodation space, and would not be easily deformed, even though pressing forces might be exerted on the fallboard 20. This will allow a metronome, writing implements, music sheets, or else to be put on the flat plate part 20-1 stably. Further in this position, the ridged rear edge region 20-4 protrudes upward from the plane of the flat plate part 20-1, which will serve to prevent music sheets, writing implements, or else which are put on the fallboard 20 from falling down on to the keyboard 22.

Figure 6:
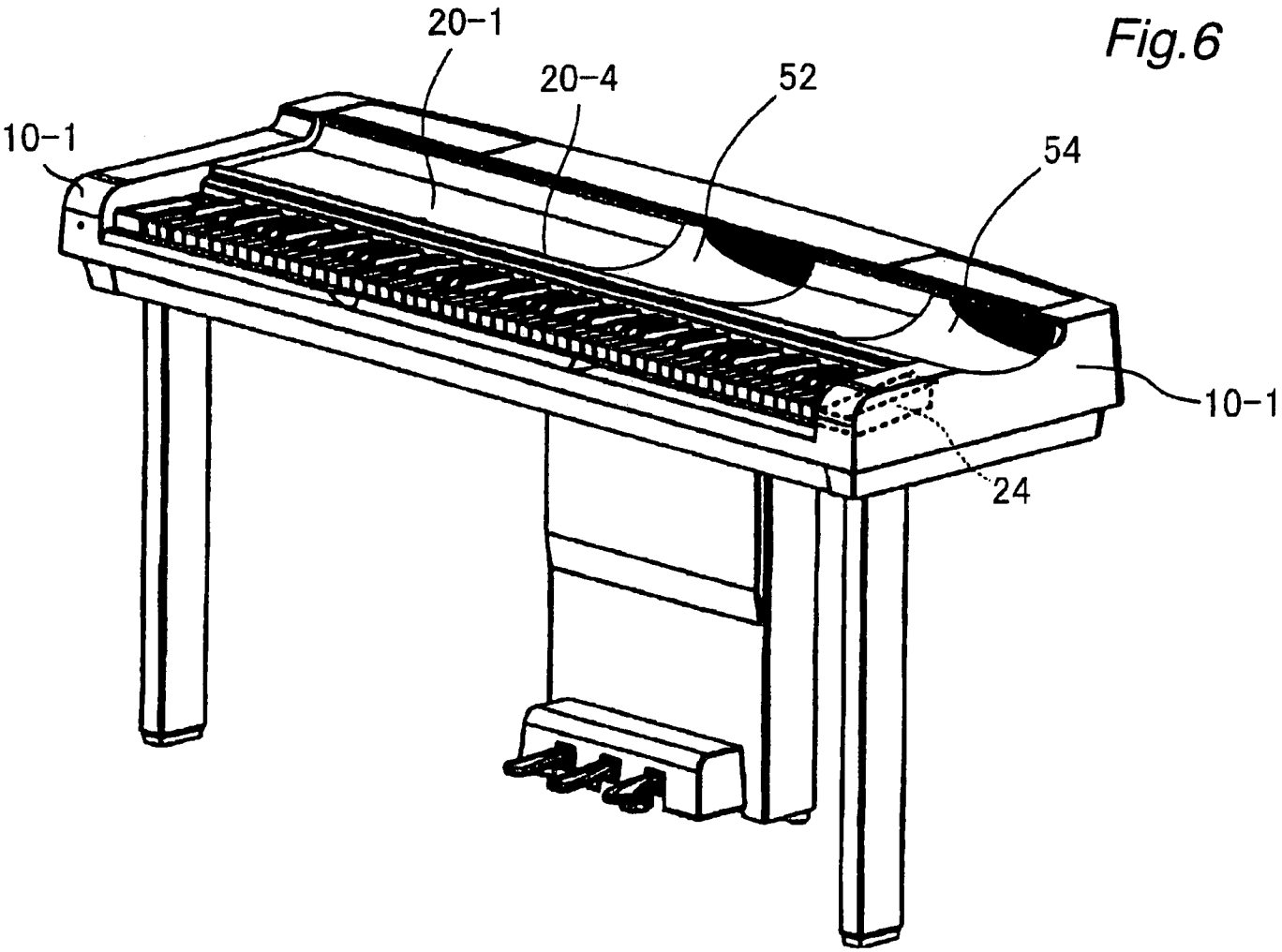
FIG. 6 is a perspective view of an electronic piano according to an embodiment of the present invention, with music sheets placed on the flip side surface of the fallboard.

FIG. 6 shows the electronic piano with its fallboard turned open as shown in FIG. 2 and with music sheets 52 and 54 placed on the flip side surface of the flat plate part 20-1 of the fallboard 20. In this condition, the music sheet 52 stays within the area of the inner surface of the fallboard 20, but the music sheet 54 is placed sticking out from the fallboard 20 and going over and beyond the side board 10-1. As the top edges 10-1*a* and 10-1*b* of the side board 10-1 adjacent to the flat plate part 20-1 and the front skirt 20-2, respectively, are formed to substantially follow the curved surface of the fallboard 20, the music sheet 54 can be placed, without trouble, on the fallboard 20 and over the top edge of the right side board 10-1, sticking out from the fallboard area.

Modified Embodiments

While a preferred embodiment has been described and illustrated in detail herein above with reference to the drawings, the present invention can be practiced with various modifications without departing from the spirit of the present invention as described in the following.

(1) While the above described embodiment has a fallboard 20 which is designed with such dimensions that the L-shaped flange 20-10 of the front skirt 20-2 comes at the same height as the rear top board 34 when the fallboard 20 is in its opened position as shown in FIG. 5, the dimensions may be so determined that the L-shaped flange 20-10 comes a little bit lower than the rear top board 34. In either case, as the flange 20-10 does not extend higher than the rear top board 34, the sounds emitted from the loudspeakers 36 will not be blocked and will reach the user directly, which will assure good tone quality. As there is no obstructive protrusion in front of the rear top board 34, it is convenient for the user to write characters or something else on a paper placed on the top board 34.

(2) On the contrary, the tip end 20-10 of the front skirt 20-2 may 0062e made higher than the rear top board 34. Then, the music sheet placed on the inner surface will be more vertical so that the user can read the music sheet more easily.

Figure 7:
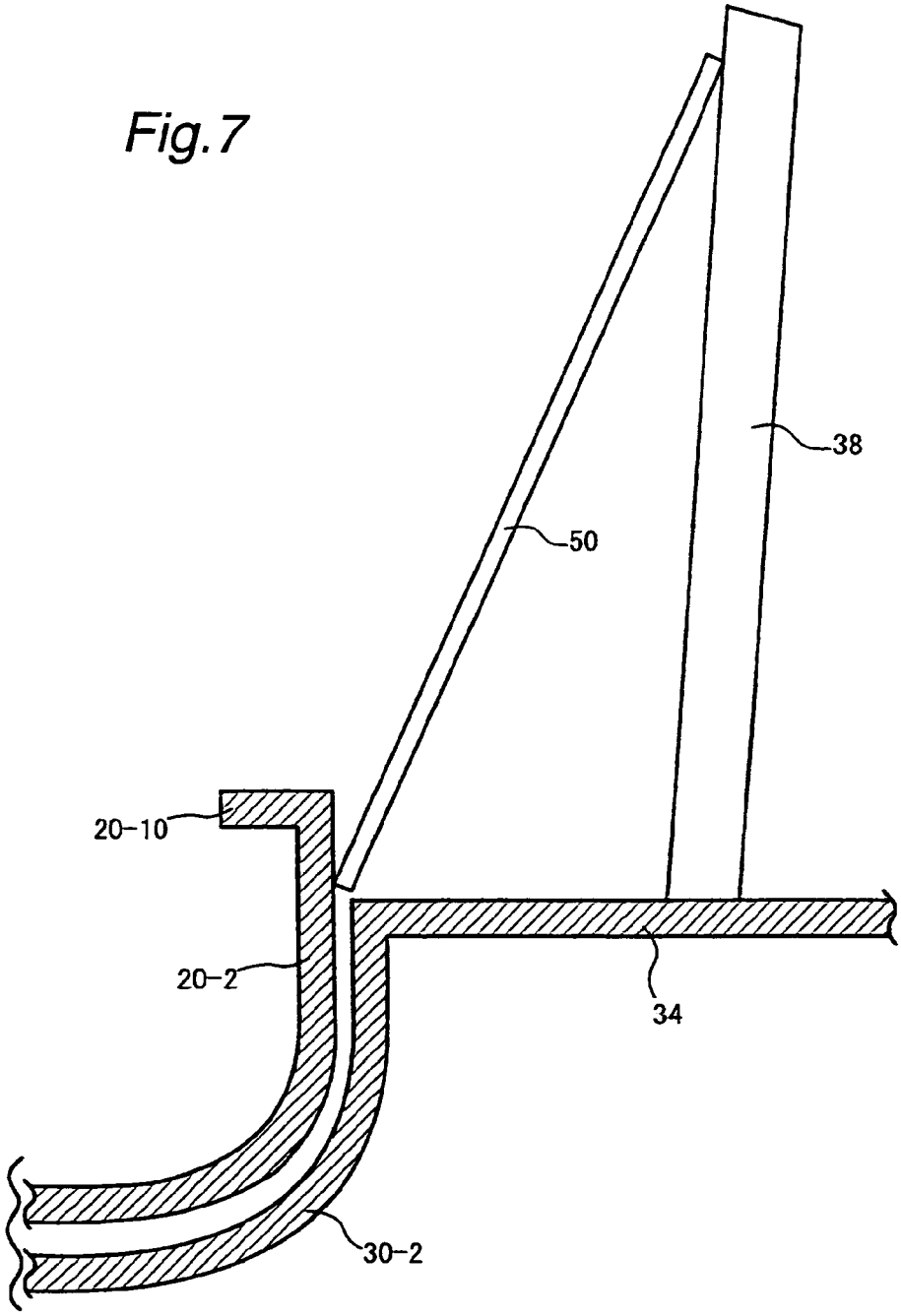
FIG. 7 is a partially-sectioned fragmentary side view near the rear top board and the front end of the fallboard according to a modified embodiment of the present invention.

(3) Alternatively, a music stand may be provided on the rear top board 34 separate from the fallboard 20 as shown, as an example, in FIG. 7. In FIG. 7, the numeral 38 denotes such an additional music stand, which extends upward slightly aslant from vertical. With the embodiment illustrated in FIG. 7, the tip end 20-10 of the front skirt 20-2 of the fallboard 20 in its opened position protrudes higher than the rear top board. According to this structure, the bottom edge of a music sheet 50 which is leaned against the music stand 38 will be stopped by the front skirt 20-2, which will prevent the music sheet 50 from slipping down. The relative position of the rear top board 34 in the embodiment of FIG. 7 is shown by a dash-single-dot line B in FIG. 5. In this modified embodiment, the accommodation height hv is less than the height hc of the front skirt 20-2 of the fallboard 20.

(4) Further, while the top edge 10-1*a* of the side board 10-1 adjacent to the flat plate part 20-1 of the fallboard 20 in its opened position is made higher than the flat plate part 20-1 by several millimeters in the above described embodiment, the height of the former may otherwise be level with the latter. Further alternatively, the flat plate part 20-1 of the fallboard 20 in its opened position may be higher than the top edge 10-1*a* of the side board 10-1. However, the height difference between the two had better be an amount with which the music sheet 54 shown in FIG. 6 can be placed over the two without problem, for example about +/−8 millimeters. Similarly, while the top edge 10-1*b* of the side board 10-1 adjacent to the front skirt 20-2 of the fallboard 20 in its opened position is formed to completely follow the curved inner shape of the front skirt 20-2, there may be a height difference of the similar amount between the top edge 10-1*b* of the side board and the front skirt 20-2 of the fallboard.

Various Embodiments (1) The fallboard 20 can be designed with such dimensions that the tip edge 20-10 of the front skirt 20-2 comes higher than the rear top board 34 while the fallboard is in its opened position.

(2) The fallboard 20 can be designed with such dimensions that the tip edge 20-10 of the front skirt 20-2 comes lower than the rear top board 34 while the fallboard is in its opened position.

(3) A pair of keyslips 17 can be provided spaced apart by a cutout therebetween on the main body 10 of the instrument in front of the keyboard 22 so that the tip edge 20-10 of the front skirt 20-2 of the fallboard 20 abuts the keyslips 17 while the fallboard 20 is in its closed position.

(4) The pivot bearing 40 which supports the pivot shaft 42 can be equipped with a brake which works to damp the rotation of the pivot shaft 42 about the pivot axis P in predetermined angle ranges before the complete opening and before the complete closure of the fall board 20.

While particular embodiments of the invention and particular modifications have been described, it should be expressly understood by those skilled in the art that the illustrated embodiments are just for preferable examples and that various modifications and substitutions may be made without departing from the spirit of the present invention so that the invention is not limited thereto, since further modifications may be made by those skilled in the art, particularly in light of the foregoing teachings.

It is therefore contemplated by the appended claims to cover any such modifications that incorporate those features of these improvements in the true spirit and scope of the invention.

What is claimed is:

1. A keyboard musical instrument comprising:

two side boards provided apart from each other, each having front part with a top edge and rear part with an upper region;

a keyboard including a plurality of playing keys, provided between said two side boards at the front parts thereof;

a rear top board provided bridging the upper regions of the rear parts of said two side boards, said rear top board having an upper surface;

a fallboard having a substantially flat plate part carrying an outer surface, and an inner surface, a front edge region and a rear edge region, said fallboard pivotably supported to turn about a pivot axis at said rear edge region between said two side boards, and covering said keyboard when said fallboard is closed by turning frontward with said outer surface being horizontal and facing upward, while exposing said keyboard when said fallboard is opened by turning rearward with said inner surface being horizontal and facing upward; and an accommodation space provided in the form of a recess having a flat-bed part that is substantially flat between said keyboard and said rear top board between said two side boards, and adapted for receiving said fallboard when said fallboard is turned rearward with said inner surface being horizontal and facing upward, wherein said flat-bed part has a height that keeps said inner surface of the fallboard not higher than said top edges of the front parts of said two side boards when said fallboard is received in said accommodation space, said front edge region including a front skirt for covering front side of said keyboard when said fallboard is closed, said front skirt having a tip edge that positions at a substantially same height as said upper surface of said rear top board when said fallboard is opened, wherein said top edge of said side board at said front part which is adjacent to said substantially flat plate part of said fallboard is of a substantially same height as said substantially flat plate part in its opened position.

2. A keyboard musical instrument as claimed in claim 1, wherein said front skirt has a height which is less than the difference between the height of said rear top board and the height of said bed part but is greater than the height of said playing keys to be covered.

3. A keyboard musical instrument as claimed in claim 1, wherein said front skirt of said fallboard is integrally formed with and gradually curving downward from said flat plate part of said fallboard.

4. A keyboard musical instrument as claimed in claim 1, wherein said recess is formed with a rear end wall connected with said bed part and rising toward said rear top board, said rising wall having a shape which matches the shape of said front skirt of said fallboard, when said fallboard is received in said accommodation space, and the top edges of said side boards are shaped along the shapes of said bed part and said rising wall adjacent to said side boards.

5. A keyboard musical instrument as claimed in claim 1, wherein said accommodation space is a recess formed between said two side boards and having a substantially flat bed part and a rear end wall having a wall height and connected with said flat bed part, and the top edges of the front parts of said side boards extend from its front to the rear end of said bed part at a height lower than said rear top board by a height difference which is less than said wall height.

6. A keyboard musical instrument as claimed in claim 1, wherein said fallboard has a ridge formed around said pivot axis at said rear end region, said ridge protruding upward from said flat plate part of said fallboard when said fallboard is turned open and lies on said accommodation space.

7. A keyboard musical instrument as claimed in claim 1, further comprising: a plurality of loudspeakers arrayed on said rear top board along a direction parallel to the direction in which said plurality of playing keys are arrayed in said keyboard.

* * * * *